US007331326B2

(12) United States Patent
Arai et al.

(10) Patent No.: US 7,331,326 B2
(45) Date of Patent: Feb. 19, 2008

(54) CARBURETOR AUTOMATIC CONTROL SYSTEM IN ENGINE

(75) Inventors: Tetsuya Arai, Saitama (JP); Hiroshi Moriyama, Saitama (JP); Takashi Suzuki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/636,718

(22) Filed: Dec. 11, 2006

(65) Prior Publication Data

US 2007/0151544 A1 Jul. 5, 2007

(30) Foreign Application Priority Data

Dec. 14, 2005 (JP) ..... 2005-360270

(51) Int. Cl.
*F02D 29/02* (2006.01)
*F02M 1/08* (2006.01)

(52) U.S. Cl. ..... 123/361; 123/179.18; 123/339.24; 123/376; 123/400; 123/442; 261/39.2; 261/39.4; 261/52

(58) Field of Classification Search ..... 123/179.16, 123/179.18, 339.22, 339.24, 361, 376, 400, 123/442; 261/39.1–39.6, 52, 64.1–64.6
See application file for complete search history.

(56) References Cited

U.S. PATENT DOCUMENTS 6,598,586 B2 * 7/2003 Deschamps et al. ..... 123/376
7,213,555 B2 * 5/2007 Kamimura et al. .... 123/179.18
7,246,794 B2 * 7/2007 Suzuki et al. ..... 123/376

FOREIGN PATENT DOCUMENTS

JP 57-182241 U 11/1982
JP 5-209547 A 8/1993

* cited by examiner

*Primary Examiner*—T. M Argenbright
(74) *Attorney, Agent, or Firm*—Westerman, Hattori, Daniels & Adrian, LLP.

(57) ABSTRACT

A carburetor automatic control system in an engine includes, a temperature-sensitive operating device for operating a choke valve so that the choke valve is opened with a temperature increase of the engine and a governor for opening and closing a throttle valve to maintain a preset rotational speed of the engine. The governor device includes, a stepping motor opening and closing the throttle valve over a range from an idling opening degree to a fully opening degree, and an electronic control unit driving the stepping motor so that the rotational speed of the engine is maintained the preset speed. A relief mechanism is interposed between the choke valve and the temperature-sensitive operating device, the relief mechanism opening the choke valve in response to an intake vacuum pressure within the intake passage when the engine is in a cold state and the choke valve is in a fully closed state.

6 Claims, 10 Drawing Sheets

COLD STOPPED STATE

COLD IDLING STATE

COLD MEDIUM-SPEED STATE

COLD HIGH-SPEED STATE

HOT HIGH-SPEED STATE

CARBURETOR AUTOMATIC CONTROL SYSTEM IN ENGINE

RELATED APPLICATION DATA

The Japanese priority application No. 2005-360270 upon which the present application is based is hereby incorporated herein, in its entirety, by reference.

BACKGROUND OF THE INVENTION

The present invention relates to a carburetor automatic control system in an engine, and particularly to an improvement of a carburetor automatic control system in an engine. More specifically, it includes a temperature-sensitive operating device for operating a choke valve mounted in an intake passage of a carburetor so that the choke valve is opened in correspondence to increase in temperature of the engine, and a governor device for opening and closing a throttle valve mounted in the intake passage at a position downstream from the choke valve so as to maintain a preset rotational speed of the engine.

DESCRIPTION OF THE RELATED ART

Japanese Utility Model Application Laid-open No. 57-182241 discloses a carburetor comprising a temperature-sensitive operating device for operating a choke valve of the carburetor so that the choke valve is opened in correspondence to an increase in the temperature of the engine. Also, Japanese Patent Application Laid-open No. 5-209547 discloses an arrangement in which a centrifugal governor device is mounted in a carburetor of an engine so as to open and close a throttle valve of the carburetor to maintain a preset rotational speed of an engine.

The conventional centrifugal governor device cannot structurally exhibit an effective speed-regulating function in an extremely low rotational speed range of the engine. Therefore, also in a non-loaded operation of the engine, the rotational speed of the engine is controlled to be a preset rotational speed higher than a regular idling rotational speed. This is not economical.

SUMMARY OF THE INVENTION

Accordingly, it is an object of the present invention to provide a carburetor automatic control system in an engine, wherein a throttle valve of a carburetor can be automatically controlled by a governor device over an entire range from an idling opening degree to a fully opening degree of the throttle valve, whereby the rotational speed of the engine can be controlled to a desired preset rotational speed in a range from an idling rotational speed to a high rotational speed without causing an engine stalling.

In order to achieve the above object, according to the present invention, there is provided a temperature-sensitive operating device for operating a choke valve mounted in an intake passage of a carburetor so that the choke valve is opened in correspondence to increase in temperature of the engine; and a governor device for opening and closing a throttle valve mounted in the intake passage at a position downstream from the choke valve so as to maintain a preset rotational speed of the engine, wherein the governor device comprises an electric actuator capable of opening and closing the throttle valve over a range from an idling opening degree to a fully opening degree, and an electronic control unit adapted to operate the electric actuator to open and close the throttle valve so that the rotational speed of the engine is maintained at the preset rotational speed, and wherein a relief mechanism is interposed between the choke valve and the temperature-sensitive operating device, the relief mechanism opening the choke valve in response to an intake vacuum pressure within the intake passage when the engine is in a cold state in which the choke valve is in a fully closed state.

According to the present invention, the electronic control unit and the electric actuator are operated so that the throttle valve of the carburetor is automatically controlled over an entire range from an idling opening degree to a fully opening degree of the throttle valve, whereby the rotational speed of the engine can be regulated to a desired preset rotational speed in a range from an idling rotational speed to a high rotational speed without causing an engine stalling. Particularly when the engine is in a non-loaded state, the engine is stabilized to the idling state, so that improvement in the fuel consumption can be expected.

Further, not only the opening degree of the choke valve can be automatically regulated by the temperature-sensitive operating device in accordance with the temperature of the engine, but also during cold idling of the engine, the idling state can be stabilized by the operation of the relief mechanism interposed between the choke valve and the temperature-sensitive operating device, thereby moderately opening the choke valve to stabilize the idling state.

Furthermore, upon hot stopping of the engine, the choke valve is maintained by the temperature-sensitive operating device at a fully opening degree or a near fully opening degree, unless the temperature of the engine decreases to a predetermined value or less. Therefore, upon the hot restarting, the concentration of a produced air-fuel mixture in the intake passage becomes suitable for the hot restarting, leading to an improvement in hot re-startability.

The electric actuator corresponds to a stepping motor in an embodiment of the present invention which will be described hereinafter, and the relief mechanism corresponds to a relief lever 41 and a relief spring 42 of the embodiment.

The above and other objects, features and advantages of the invention will become apparent from the following description of the preferred embodiment taken in conjunction with the accompanying drawings.

BRIEF DESCRIPTION OF THE DRAWINGS

The advantages of the invention will become apparent in the following description taken in conjunction with the drawings, wherein.

DETAILED DESCRIPTION OF THE PREFERRED EMBODIMENT

Figure 1:
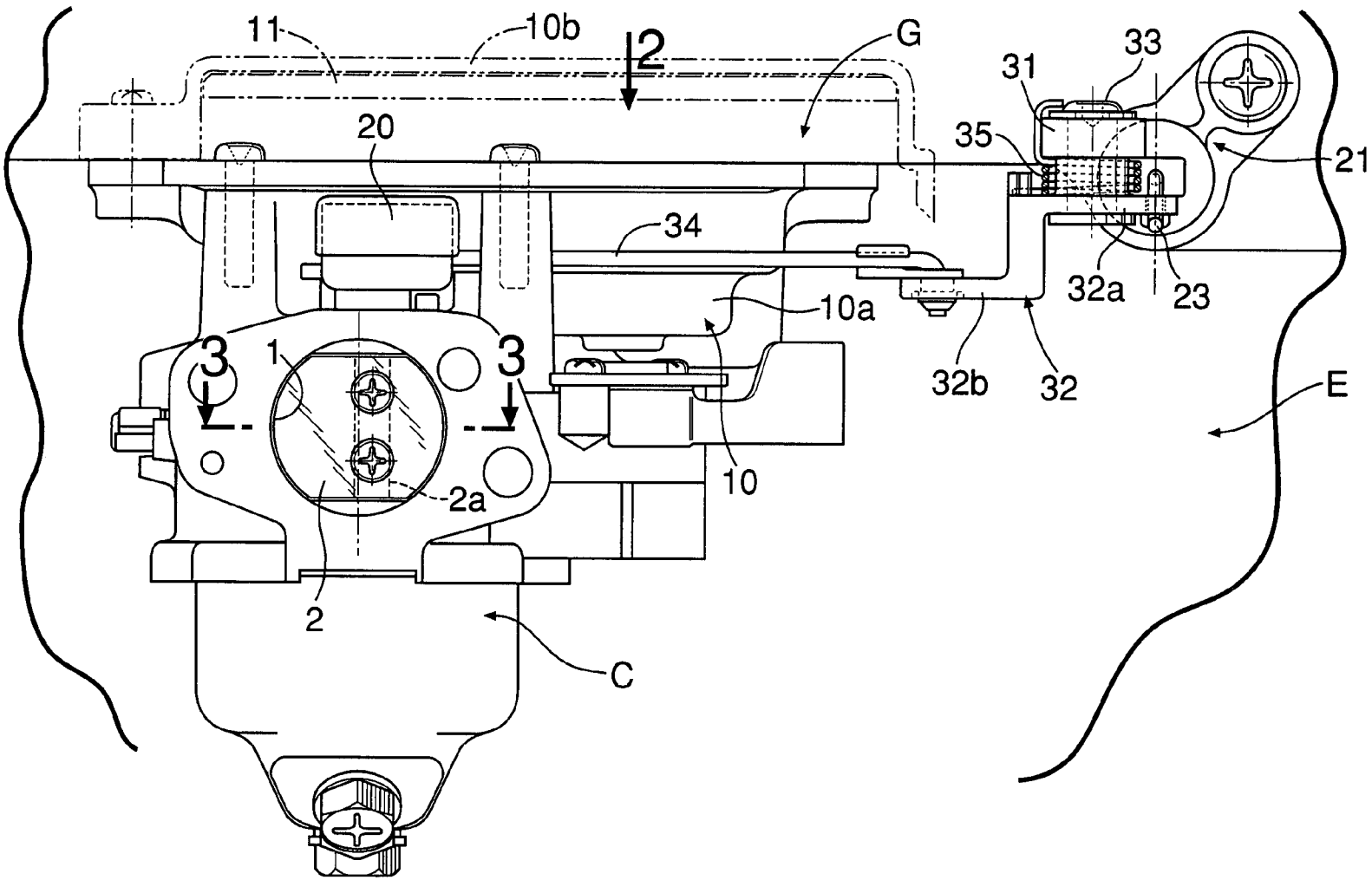
FIG. 1 is a front view of a general-purpose engine including a carburetor automatic control system according to an embodiment of the present invention.
Figure 2:
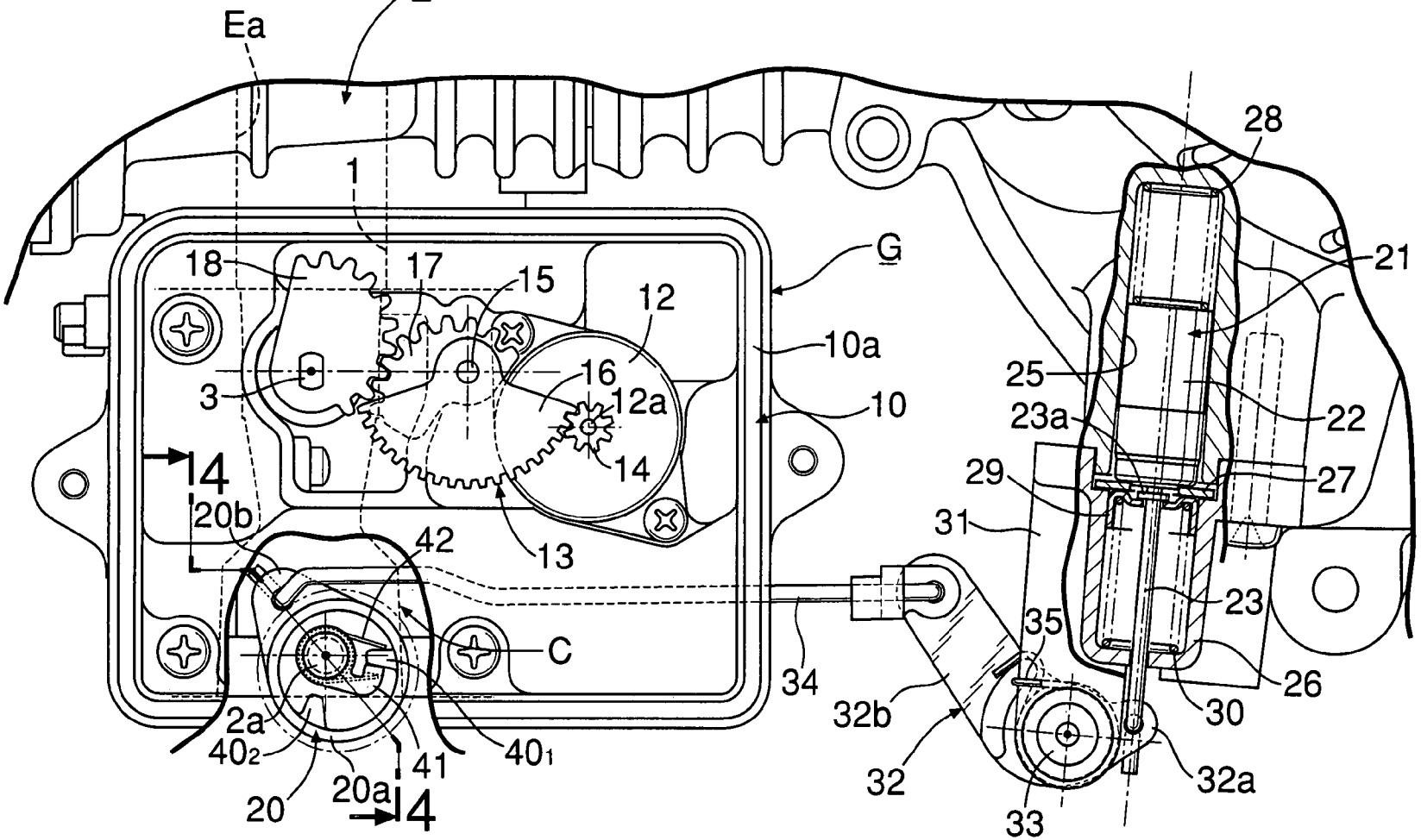
FIG. 2 is a view taken in a direction of an arrow 2 in FIG. 1.
Figure 3:
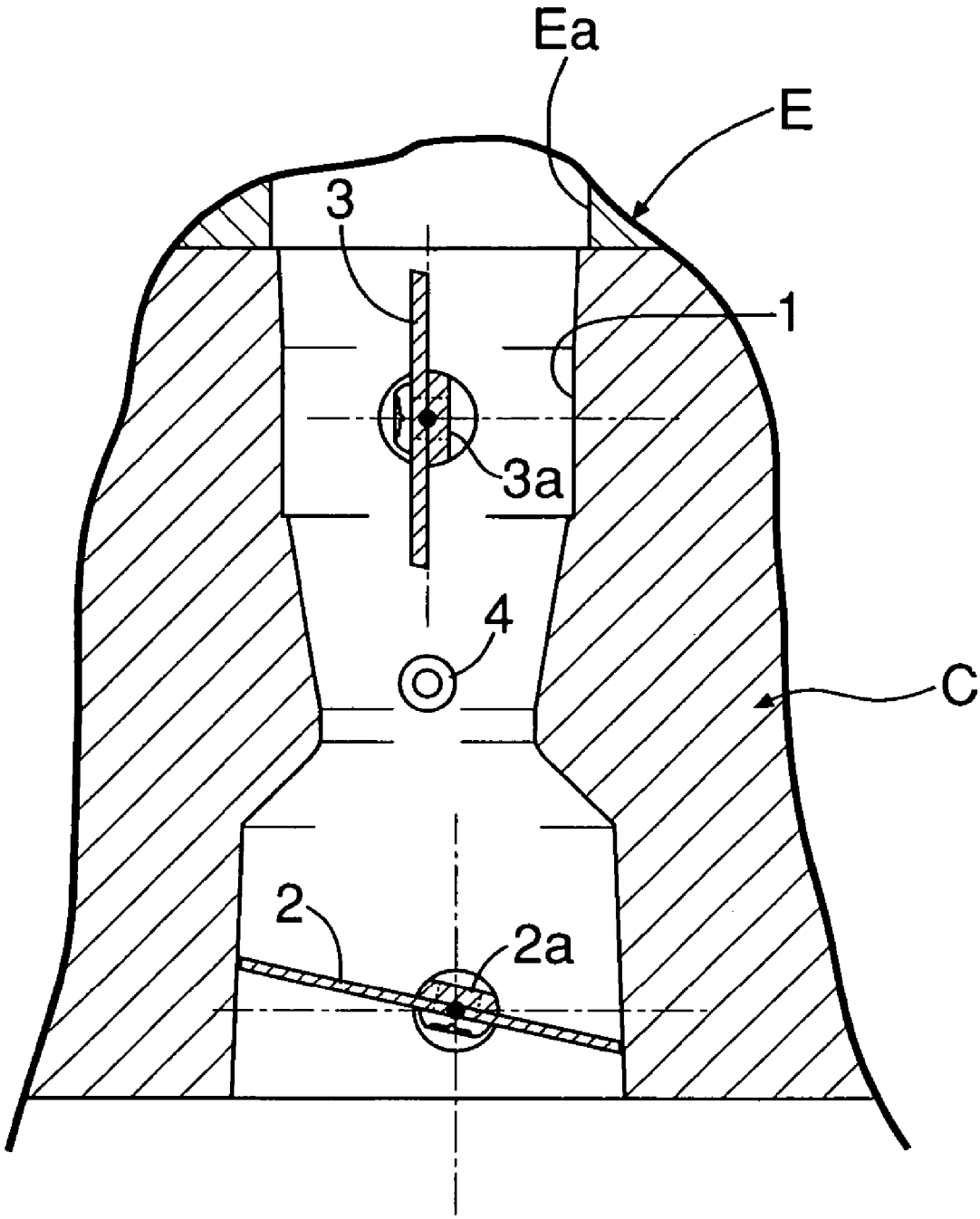
FIG. 3 is a sectional view taken along a line 3-3 in FIG. 1.

Referring first to FIGS. 1 to 3, a carburetor C is mounted to one side of a general-purpose engine E, into which an intake port Ea opens. A choke valve 2 and a throttle valve 3 are disposed, sequentially from an upstream side, in an intake passage 1 leading to the intake port Ea. A fuel nozzle 4 opens into a venturi portion of the intake passage 1 at an intermediate position between the valves 2 and 3. Each of the choke valve 2 and the throttle valve 3 is formed into a butterfly type adapted to be opened and closed by the rotation of a valve shaft 2*a* or 3*a*. A governor device G for automatically controlling the opening degree of the throttle valve 3 is mounted to an upper portion of the carburetor C.

The valve shaft 2*a* of the choke valve 2 will be hereinafter referred to as a choke valve shaft, and the valve shaft 3*a* of the throttle valve 3 as a throttle valve shaft.

The governor device G will be described below with reference to FIGS. 1 and 2. The governor device G has a casing 10 which comprises a casing body 10*a* coupled to an upper end face of the carburetor C, and a lid plate 10*b* coupled to the casing body 10*a* to close an opening face of the casing body 10*a*. An electronic control unit 11 is mounted on a ceiling face of the lid plate 10*b*.

A stepping motor 12 and a transmission device 13 for transmitting an output torque of the stepping motor 12 to the throttle valve shaft 3*a* are disposed within the casing body 10*a*. The transmission device 13 comprises: a pinion 14 secured to an output shaft 12*a* of the stepping motor 12; a sector gear 16 which is rotatably supported on a support shaft 15 supported in the casing body 10*a* and which is meshed with the pinion 14; a non-constant speed driving gear 17 integrally formed on an axial one side of the sector gear 16; and non-constant speed driven gear 18 secured to an outer end of the throttle valve shaft 3*a* and meshed with the non-constant speed driving gear 17. Each of the non-constant speed driving and driven gears 17 and 18 comprises a part of an elliptic or eccentric gear, and they are designed so that a gear ratio therebetween, i.e., a speed reduction ratio is decreased with an increase in opening degree of the throttle valve 3. Therefore, the speed reduction ratio assumes a maximum value in the fully closed state of the throttle valve 3. With this arrangement, a meticulous control of the opening degree can be performed by the operation of the stepping motor 12 in a region of low opening degree including an idling opening degree of the throttle valve 3.

Figure 4:
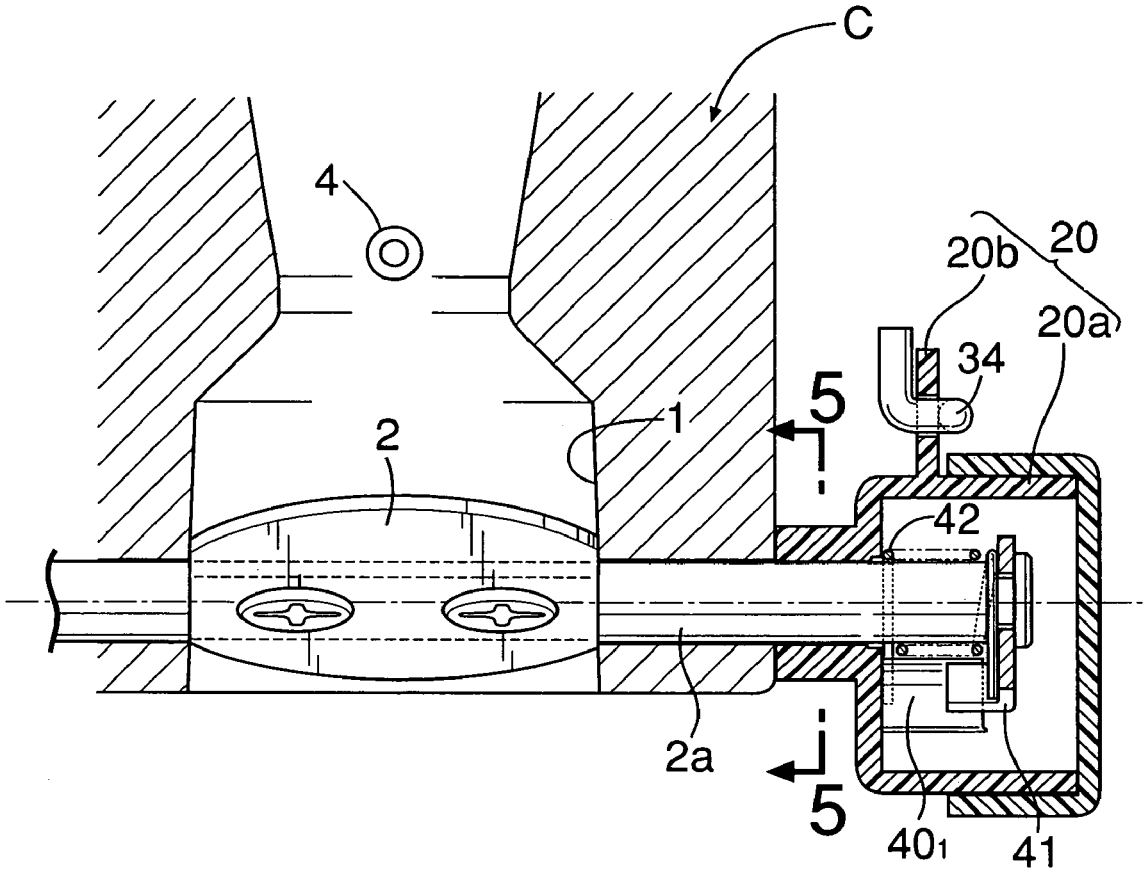
FIG. 4 is a sectional view taken along a line 4-4 in FIG. 2.
Figure 5:
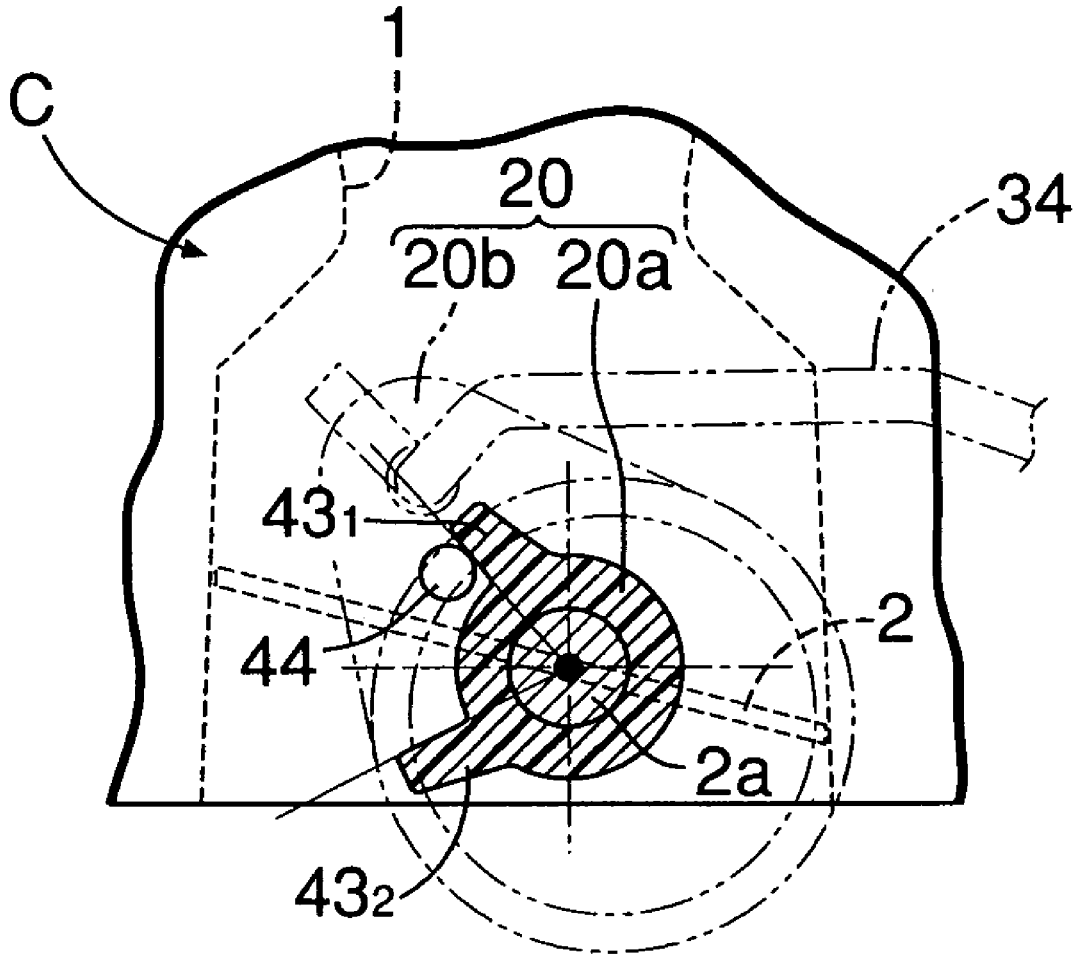
FIG. 5 is a sectional view taken along a line 5-5 in FIG. 4.

As shown in FIGS. 3 to 5, the choke valve shaft 2*a* is disposed so that it is offset to one side from the centerline of the intake passage 1. In the fully closed state, the choke valve 2 is inclined with respect to the centerline of the intake passage 1 so that its large-radius side is positioned downstream of the intake passage 1 as compared with its small-radius side. A choke lever 20 is mounted to an outer end of the choke valve shaft 2*a* protruding out of the carburetor C. The choke lever 20 comprises: a bottomed cylindrical hub 20*a* rotatably fitted over the choke valve shaft 2*a*; and a lever arm 20*b* projectingly integrally provided on one side of the hub 20*a*.

First and second stopper projections $\mathbf{40}_1$ and $\mathbf{40}_2$ are formed inside the hub 20*a*, and arranged circumferentially at predetermined intervals. A relief lever 41 capable of being turned only between the stopper projections $\mathbf{40}_1$ and $\mathbf{40}_2$ is secured to the choke valve shaft 2*a*. A relief spring 42 is mounted between the hub 20*a* and the relief lever 41 so as to urge the relief lever 41 into abutment against the first stopper projection $\mathbf{40}_1$ located on a closed side of the choke valve 2.

First and second stopper walls $\mathbf{43}_1$ and $\mathbf{43}_2$ are formed on an outer periphery of a lower portion of the hub 20*a*, and arranged circumferentially at intervals. A stopper pin 44 is projectingly provided on an outer face of the carburetor C, and disposed between the stopper walls $\mathbf{43}_1$ and $\mathbf{43}_2$.

Thus, the first stopper wall $\mathbf{43}_1$ abuts against the stopper pin 44 to define a closing position of the choke lever 20 for fully closing the choke valve 2; and the second stopper wall $\mathbf{43}_2$ abuts against the stopper pin 44 to define an opening position of the choke lever 20 for fully opening the choke valve 2.

When an intake vacuum pressure of the engine exceeds a certain value at a fully closing degree or low opening degree, a difference between a rotational moment caused by the intake vacuum pressure (meaning a negative pressure created by intake vacuum action) acting on the large-radius side of the choke valve 2 and a rotational moment caused by the intake vacuum pressure acting on the small-radius side of the choke valve 2 overcomes a rotational moment caused by the relief spring 42 to increase the opening degree of the choke valve 2, but this increase in opening degree is limited by the abutment of the relief lever 41 against the second stopper projection $\mathbf{40}_2$.

A wax—type temperature—sensitive operating device 21 for opening and closing the choke valve 2 in correspondence to the increase and decrease of the temperature of the engine E is connected to the choke lever 20.

The temperature-sensitive operating device 21 will be described below with reference to FIG. 2. The temperature-sensitive operating device 21 comprises: a cylindrical wax case 22 sealingly containing a wax; and an output rod 23 which is supported in one end wall of the wax case 22 so as to penetrate the one end wall and whose length of outward protrusion is increased in response to the thermal expansion of the wax in the wax case 22. The engine E has a bottomed cylindrical mounting bore 25 provided in a portion such as a cylinder head, a cylinder block and a crankcase of the engine E which can indicate the representative temperature of the engine E. The wax case 22 is fitted in the mounting bore 25. The output rod 23 is disposed to protrude out of the mounting bore 25. A cup-shaped cover 26 is secured to the engine E so as to cover an end of the wax case 22 and to slidably support an intermediate portion of the output rod 23. The cover 26 is provided with a stopper plate 27 adapted to receive an outer end face of the wax case 22. A retention spring 28 is housed in the mounting bore 25, and retains the wax case 22 at a position where it abuts against the stopper plate 27.

A retainer 29 is slidably fitted in the cover 26 to abut against an outer end face of a flange 23*a* formed in the middle of the output rod 23. A return spring 30 for urging the retainer 29 toward the stopper plate 27 is housed in the cover 26.

Thus, the output rod 23 is adapted to protrude to the outside against an urging force of the return spring 30 in correspondence to the thermal expansion of the wax in the wax case 22.

A bracket 31 is integrally formed on the cover 26, to which a bell-crank lever 32 is turnably mounted through a pivot 33. The bell-crank lever 32 includes a first arm 32*a* and a second arm 32*b* longer than the first arm 32*a*. The output rod 23 is connected at its outer end to the first arm 32*a*, which is connected to the choke lever 20 through a link 34. A choke-closing spring 35 is connected to the bell-crank lever 32 so as to urge the bell-crank lever 32 in a direction to close the choke valve 2.

Figure 6:
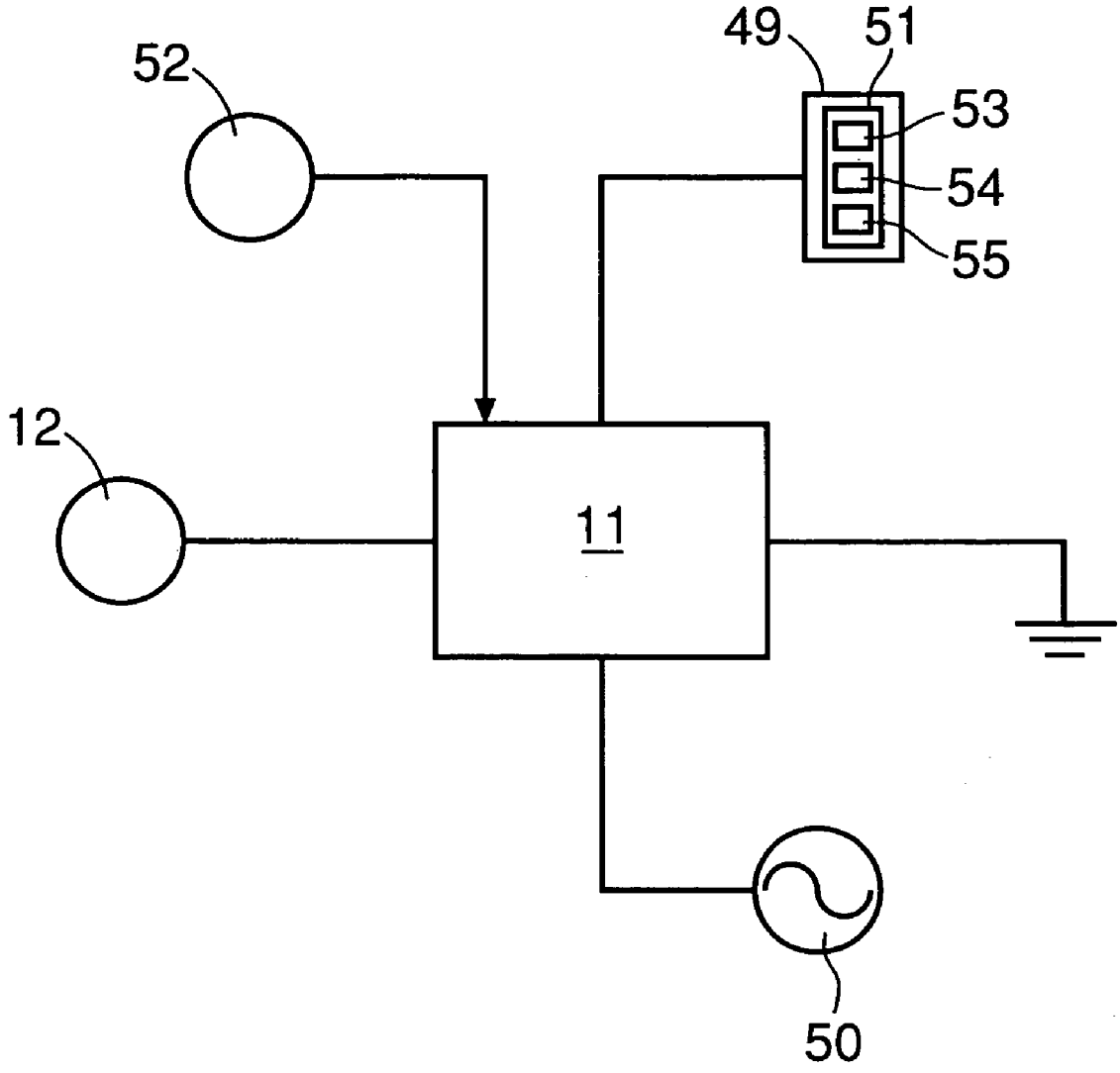
FIG. 6 is an electric circuit diagram of the carburetor automatic control system.

As shown in FIG. 6, an output from an flywheel magnet 50 mounted on the engine E as well as various signals, such as an output signal from an engine-rotational speed setting device 51 mounted on a control panel 49 for setting a desired rotational speed for the engine E and an output signal from a rotational speed sensor 52 for detecting a rotational speed of the engine E, are input to the electronic control unit 11 for controlling the operation of the stepping motor 12. In the illustrated embodiment, the engine-rotational speed setting device 51 includes an idling switch 53 for providing an idling rotational speed of, for example, 2000 rpm to the engine, a medium-speed switch 54 for providing a predetermined medium rotational speed to the engine E, and a high-speed switch 55 for providing a predetermined high rotational speed to the engine E.

The operation of this embodiment will be described below.

Immediately before stopping the operation of the engine E, the stepping motor 12 is operated in a direction to open the throttle valve 3 so as not to reduce the rotational speed of the engine E. Therefore, in a cold stopped state of the engine E, the throttle valve 3 is generally in a fully opened state already, as shown in FIGS. 2 to 4. On the other hand, in the temperature-sensitive operating device 21, the output rod 23 is retained in a most-retracted position by the shrinkage of the wax in the wax case 22 and the urging force of the return spring 30, and thus the choke lever 20 is retained at a position to fully close the choke valve 2 by pushing the link 34 through the bell-crank lever 32.

To start the engine E in this state, the idling switch 53 of the engine-rotational speed setting device 51 is first turned on prior to the cranking. If the engine E is then cranked by a starter, the electronic control unit 11 is first operated by an electric power generated by the flywheel magnet 50 by such cranking, thereby checking whether or not the stepping motor 12 is in a position corresponding to the fully opened position of the throttle valve 3. If it is determined that the stepping motor 12 is not in the position corresponding to the fully opened position, the stepping motor 12 is operated to the position corresponding to the fully opened position of the throttle valve 3.

Therefore, in the intake passage 1 of the carburetor C, an intake vacuum pressure in the engine E effectively acts on the fuel nozzle with the cranking, thereby producing a fuel-air mixture of a relatively high concentration. In this manner, the engine E can be easily started at all times.

Figure 7:
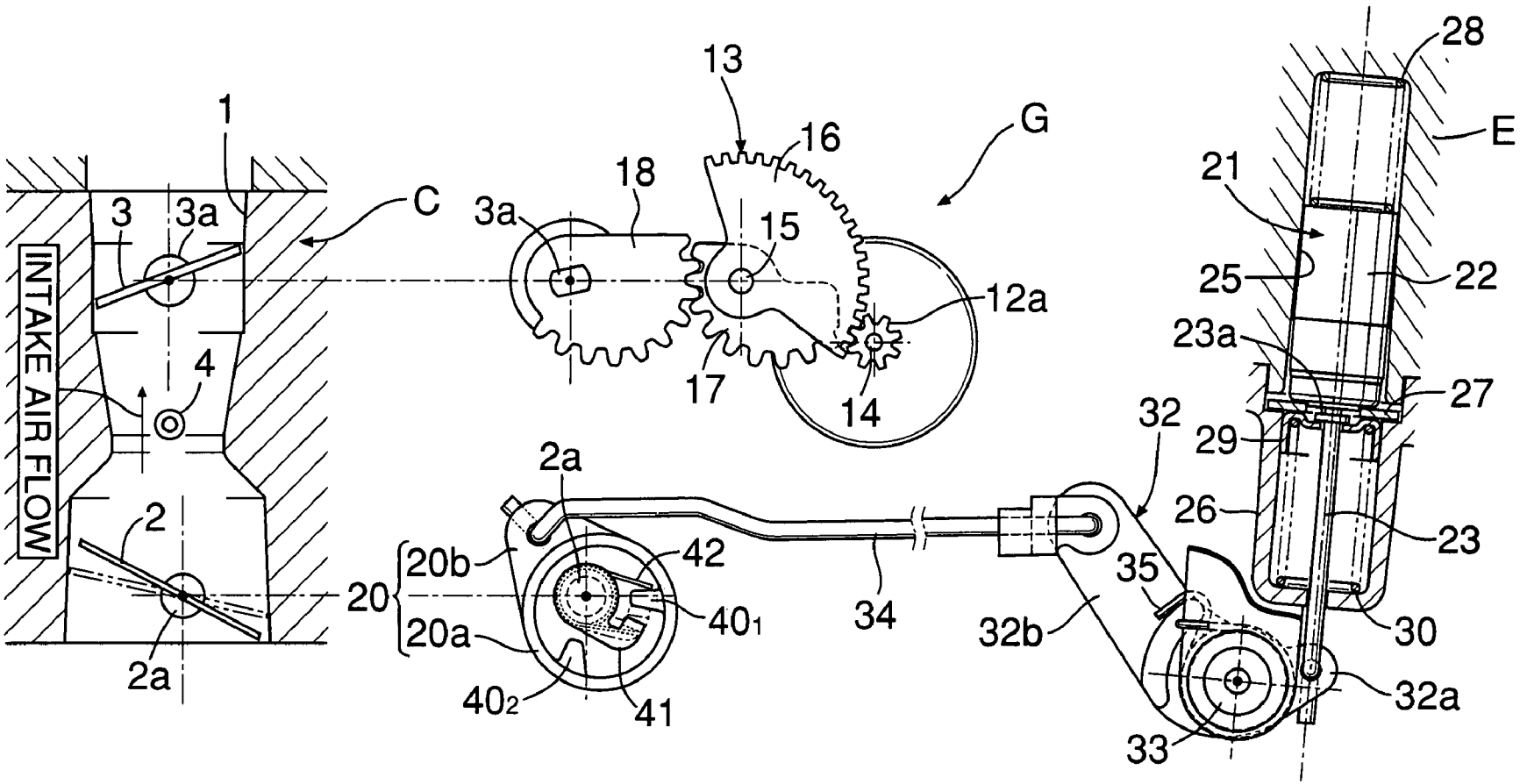
FIG. 7 is a view for explaining the operation, showing a cold idling controlled state of the carburetor automatic control system.

When the engine is completely combusted, the electronic control unit 11 then operates the stepping motor 12 based on an output signal from the idling switch 53 which is in a turned-on state and an output signal from the engine-rotational speed sensor 52, thereby closing the throttle valve 3 to the idling opening degree through the transmission device 13. That is, the idling opening degree is automatically regulated so that the rotational speed of the engine E becomes the regular idling rotational speed (see FIG. 7).

During such cold idling of the engine E, a relatively large intake vacuum pressure of the engine E acts on the-choke valve 2 which is in a fully closed state. However, as described above, the choke valve 2 is automatically opened to such an extent that the difference between the rotational moment caused by the intake vacuum pressure acting on the large-radius side of the choke valve 2 and the rotational moment caused by the intake vacuum pressure acting on the small-radius side of the choke valve 2 is balanced with the rotational moment caused by the relief spring 42. Therefore, an excessive increase in intake vacuum pressure is suppressed, and thus it is possible to prevent an excessive increase in concentration of the produced air-fuel mixture in the intake passage 1, thereby securing an excellent warming-up operational state of the engine E.

Figure 8:
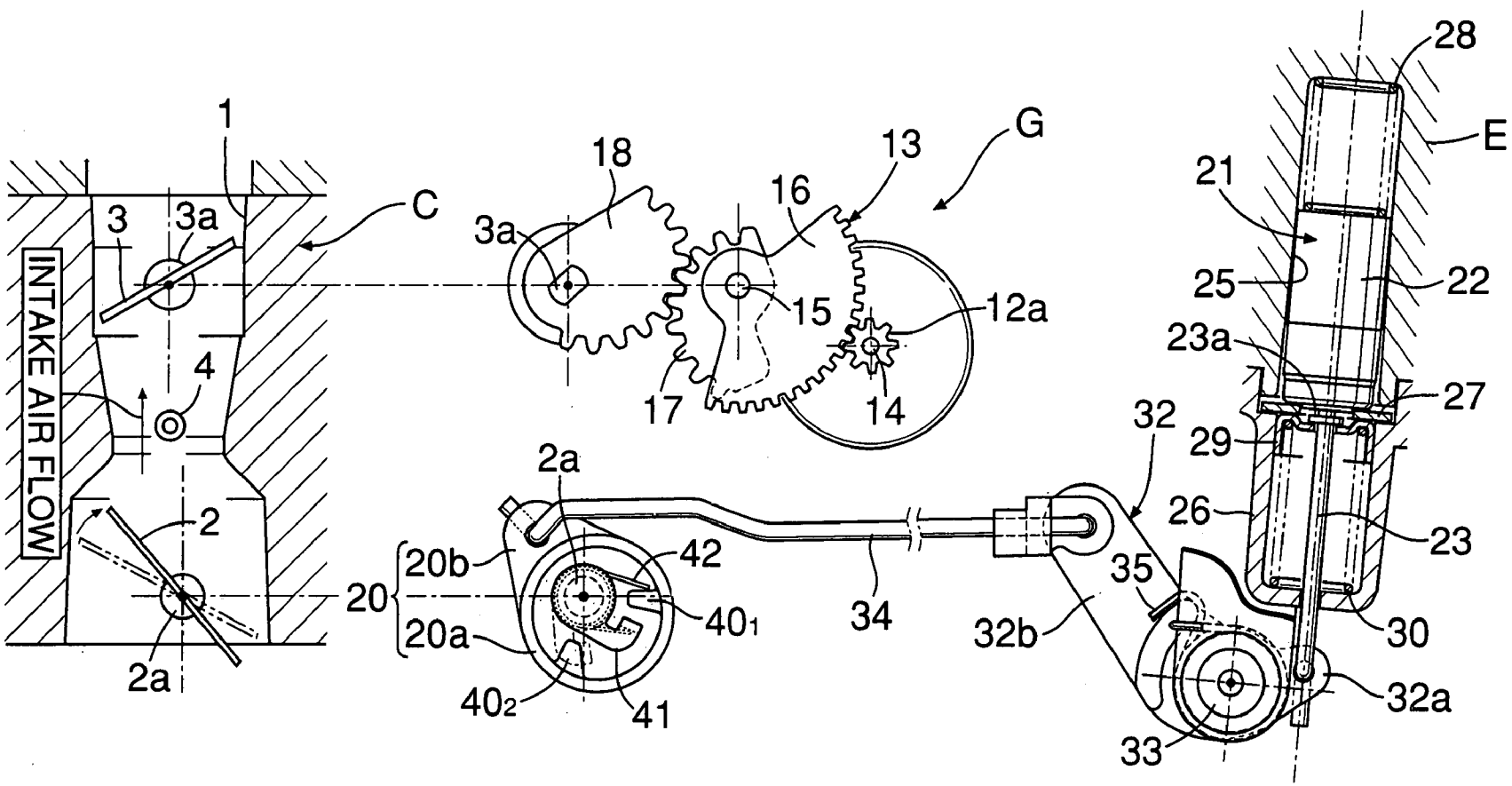
FIG. 8 is a view for explaining the operation, showing a cold medium-speed controlled state of the system.
Figure 9:
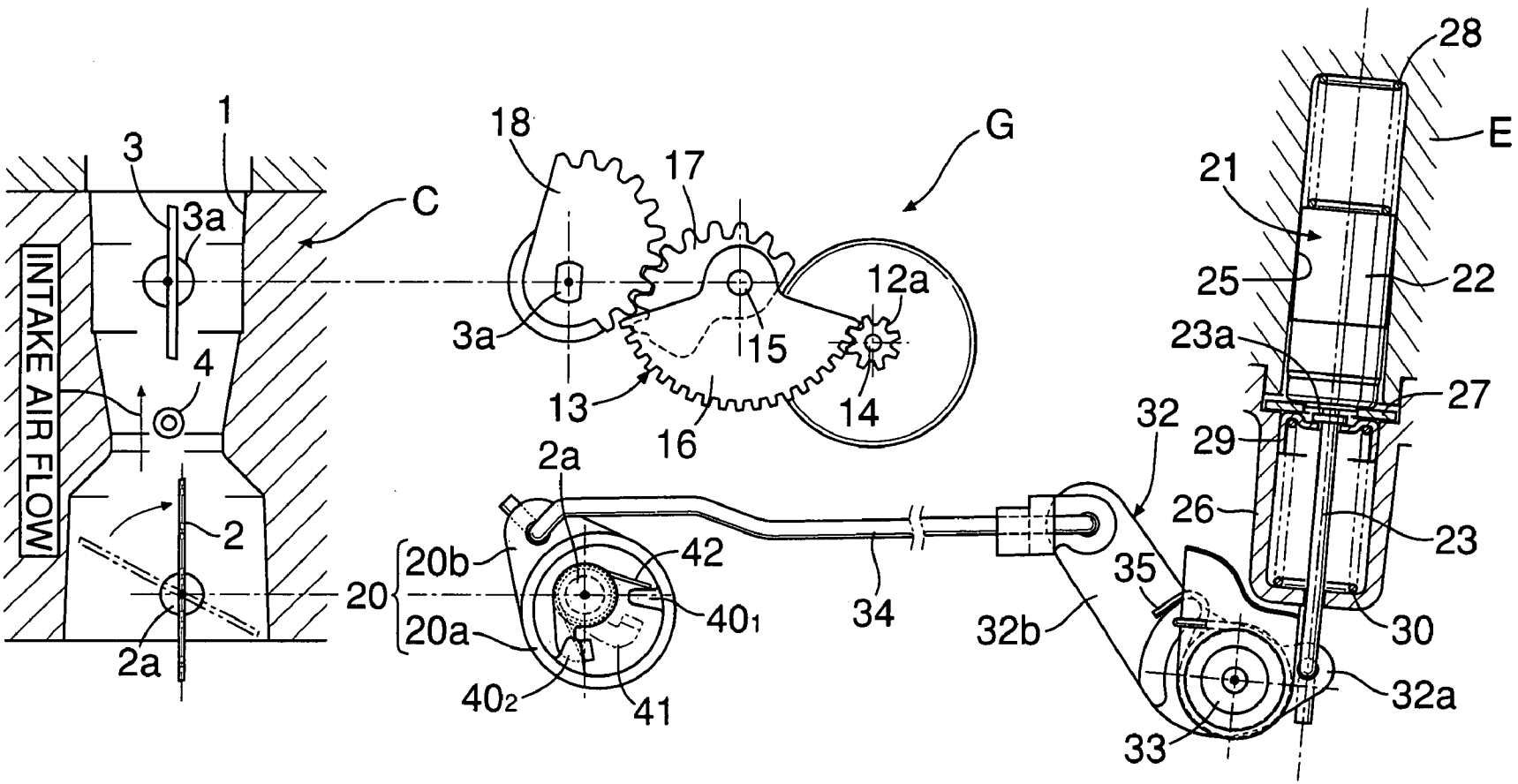
FIG. 9 is a view for explaining the operation, showing a cold high-speed controlled state of the system.

Next, when the medium-speed switch 54 or the high-speed switch 55 of the engine-rotational speed setting device 51 is turned on in order to apply a load to the engine E which is in the cold state, the electronic control unit 11 operates the stepping motor 12 based on both the output signals from the idling switch 53 and the engine-rotational speed sensor 52 to open the throttle valve 3, and the opening degree of the throttle valve 3 is automatically controlled to provide a predetermined medium or high rotational speed (see FIGS. 8 and 9).

When the engine rotational speed is increased in this manner, the intake vacuum pressure acting on the choke valve 2 is also increased, but the choke valve 2 is automatically brought into a substantially fully opened state by an increase in rotational moment in a direction to open the choke valve 2 due to such intake vacuum pressure. Therefore, also in this case, it is possible to suppress the excessive increase in intake vacuum pressure to prevent the excessive increase in concentration of the produced air-fuel mixture in the intake passage 1, thereby securing an excellent cold-loaded operational state of the engine E.

Figure 10:
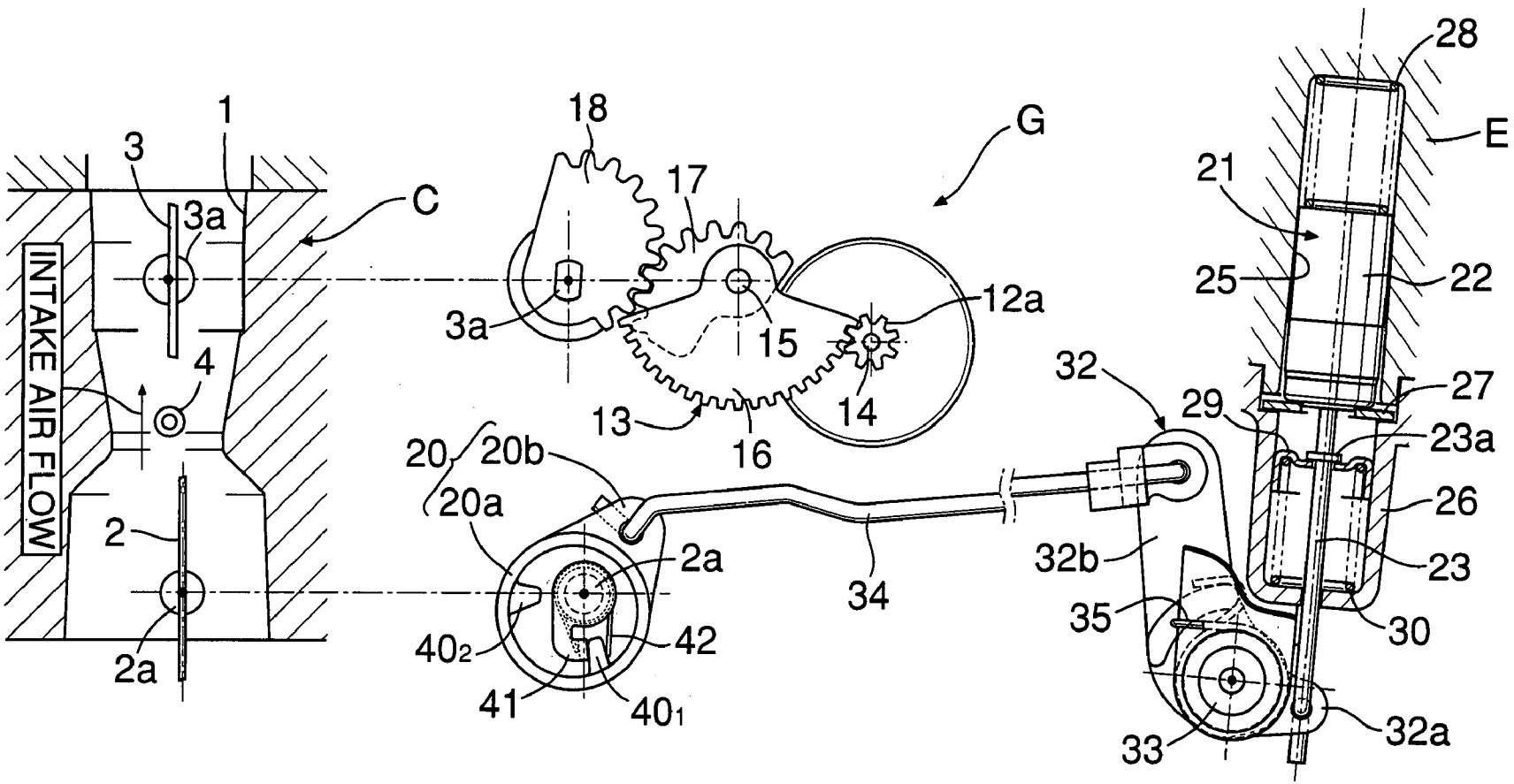
FIG. 10 is a view for explaining the operation, showing a hot high-speed controlled state of the system.

If the temperature of the engine increases as the warming-up operation progresses, the engine E correspondingly heats the wax case 22 of the temperature-sensitive operating device 21, so that the wax in the wax case 22 is expanded in accordance with this increase in the temperature of the engine, causing the output rod 23 to protrude, whereby the link 34 is drawn through the bell-cranks lever 32 to turn the choke lever 20 in a direction to open the choke valve 2. Therefore, the opening degree of the choke valve 2 can be increased without using intake vacuum pressure, and the choke valve 2 is brought into the fully opened state upon completion of the warming-up operation (see FIG. 10). Thus, the produced air-fuel mixture in the intake passage 1 has a usual concentration, and the rotational speed of the engine can be automatically accurately controlled to a rotational speed preset by the engine-rotational speed setting device 51 over a wide range from the idling rotational speed to the high-speed rotational speed.

Next, if the operation of the engine E is stopped in a hot state, the wax in the wax case 22 of the temperature-sensitive operating device 21 is maintained in the expanded state, unless the temperature of the engine decreases to a predetermined value or less, and hence the choke valve 2 is also retained in a fully opened state. Therefore, when the engine E is restarted in a hot state, the concentration of the produced air-fuel mixture in the intake passage 1 becomes suitable for the hot starting, leading to an improvement in hot start ability.

The present invention is not limited to the above-described embodiment, and various modifications in design may be made thereto without departing from the subject matter of the invention. For example, the flywheel magnet 50 can be replaced by any other generator driven by the engine E.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A carburetor automatic control system for an engine, comprising:

a choke valve disposed in an intake passage of a carburetor;

a throttle valve disposed in said intake passage at a position downstream from said choke valve;

a temperature-sensitive operating device operatively connected with said choke valve for operating said choke valve, wherein said choke valve is opened in correspondence with an increase in engine temperature;

a governor operatively connected with said throttle valve for opening and closing said throttle valve to maintain a present rotational speed of the engine, wherein said governor includes, (a) an electric actuator opening and closing said throttle valve over a range from an idling open degree to a fully open degree, and (b) an electronic control unit for controlling said electric actuator to open and close said throttle valve, such that the rotational speed of the engine is maintained at the preset rotational speed; and a relief mechanism interposed between said choke valve and said temperature-sensitive operating device, said relief mechanism opening said choke valve in response to an intake vacuum pressure within the intake passage of the engine, when the engine is in a cold state, and said choke valve is in a closed state.

2. The carburetor automatic control system of claim 1, wherein said temperature-sensitive operating device includes a wax case including wax, said wax being expandable in response to heat.

3. The carburetor automatic control system of claim 2, wherein said temperature-sensitive operating device further includes a rod, movable in response to the expansion of said wax when heated.

4. The carburetor automatic control system of claim 3, wherein said temperature-sensitive operating device is mounted on the engine, such that heat from the engine heats up wax in said wax case.

5. The carburetor automatic control system of claim 4, wherein said rod is connected to said choke valve for operating said choke valve in response to heat from the engine.

6. The carburetor automatic control system of claim 1, wherein said temperature-sensitive operating device is mounted on the engine, such that heat from the engine heats up said temperature-sensitive operating device.

* * * * *